United States Patent [19]

Takayasu

[11] Patent Number: 4,683,846

[45] Date of Patent: Aug. 4, 1987

[54] FUEL SUPPLY DEVICE OF A TWO-STROKE ENGINE FOR AN OUTBOARD MOTOR

[75] Inventor: Hidekazu Takayasu, Hamamatsu, Japan

[73] Assignee: Sanshin, Japan

[21] Appl. No.: 631,858

[22] Filed: Jul. 18, 1984

[30] Foreign Application Priority Data

Jul. 22, 1983 [JP] Japan ..... 58-132832

[51] Int. Cl.[4] ..... F02B 33/04

[52] U.S. Cl. ..... 123/73 A; 123/73 B; 123/195 HC; 123/549

[58] Field of Search ..... 123/73 A, 549, 145 R, 123/179 H, 73 B, 195 HC, 196 W, 73 R, 179 G, 73 PP, 145 A

[56] References Cited

U.S. PATENT DOCUMENTS

| | | | |
|---|---|---|---|
| 819,258 | 5/1906 | Weiss | 123/195 HC |
| 1,073,086 | 9/1913 | Blose | 123/73 B |
| 1,190,591 | 7/1916 | Rorabeck | 123/73 B |
| 1,266,118 | 5/1918 | Gray | 123/73 B |
| 1,296,214 | 3/1919 | Petter | 123/73 B |
| 1,464,253 | 8/1923 | Wales | 123/549 |
| 1,624,024 | 4/1927 | Svensson et al. | 123/73 B |
| 1,771,552 | 7/1930 | Tower | 123/59 A |
| 4,178,887 | 12/1979 | Iida | 123/73 A |
| 4,181,101 | 11/1980 | Yamamoto | 123/73 A |
| 4,253,433 | 3/1981 | Blair | 123/73 A |
| 4,258,670 | 3/1981 | Thery | 123/73 B |
| 4,286,553 | 9/1981 | Baltz et al. | 123/73 A |
| 4,333,425 | 6/1982 | Kusche | 123/73 R |
| 4,345,569 | 8/1982 | Hattori et al. | 123/549 |
| 4,373,479 | 2/1983 | Billingsley et al. | 123/179 G |
| 4,401,090 | 8/1983 | Fujimoto et al. | 123/549 |
| 4,462,346 | 7/1984 | Haman et al. | 123/73 A |
| 4,469,054 | 9/1984 | Onishi et al. | 123/73 R |
| 4,498,434 | 2/1985 | Baltz et al. | 123/187.5 R |
| 4,543,921 | 10/1985 | Torigai et al. | 123/549 |

FOREIGN PATENT DOCUMENTS

| | | | |
|---|---|---|---|
| 58-4167 | 9/1972 | Japan . | |
| 0074707 | 6/1977 | Japan | 123/73 A |
| 47-36534 | 1/1983 | Japan . | |
| 0170823 | 10/1983 | Japan | 123/73 B |
| 2115485 | 9/1983 | United Kingdom | 123/73 B |

*Primary Examiner*—Craig R. Feinberg
*Assistant Examiner*—David A. Okonsky
*Attorney, Agent, or Firm*—Ernest A. Beutler

[57] ABSTRACT

A two-cycle crankcase compression internal combustion engine for use in an outboard motor that facilitates the use of low quality fuels by providing a carburetor that discharges fuel directly into one of the transfer passages of the engine. The transfer passages and carburetors are disposed so that the carburetors may extend horizontally and permits the use of a plurality of carburetors, one spaced above the others.

26 Claims, 5 Drawing Figures

FUEL SUPPLY DEVICE OF A TWO-STROKE ENGINE FOR AN OUTBOARD MOTOR

BACKGROUND OF THE INVENTION

This invention relates to a fuel supply device of a two-cycle engine for an outboard motor and more particularly to an improved, compact and efficient fuel system for a two-cycle engine.

Two-cycle engines have, as one of their principal advantages, extreme simplicity. Because of this, two-cycle engines enjoy a wide variety of applications, for example, in outboard motors. With a crankcase compression two-cycle engine, it is the normal practice to draw a fuel/air mixture into the crankcase for compression. The compressed mixture is then transferred to the combustion chamber through one or more transfer ports where it is fired. The rather lengthy path through which the fuel/air mixture must pass gives rise to some difficulties, particularly when low quality fuels such as kerosene are employed. When using such fuels, there is a likelihood of condensation of the fuel before it reaches the combustion chamber. This is particularly true under such conditions as starting and during acceleration. The condensation can cause a weaker than desired mixture which can make running conditions either unsatisfactory or, in extreme cases, impossible.

It is, therefore, a principal object of this invention to provide an improved fuel supply system for a two-cycle internal combustion engine.

It is another object of this invention to provide an improved fuel supply system for a two-cycle crankcase compression internal combustion engine wherein the likelihood of condensation is reduced, thus rendering the engine more adaptable for running with low quality fuels.

As has been noted, their simplicity makes two-cycle engines very desirable for use as the power unit of an outboard motor. In such an application, the engine is disposed so that its output shaft rotates about a generally vertically extending axis. This results in cylinders that are horizontally disposed. Normally, it has been the practice to induct the fuel/air mixture into the crankcases from generally horizontally disposed carburetors. As has been discussed above, however, the crankcase induction causes the likelihood of fuel condensation, particularly when low quality fuels are employed. However, other alternative locations for introduction of the fuel have been rather difficult due to the extremely compact nature of the outboard motor and its surrounding protective cowling.

It is, therefore, a principal object of a further feature of this invention to provide an improved, compact, high efficiency induction system for a two-cycle internal combustion engine.

It is a further object of this invention to provide am improved layout and arrangement for introducing fuel into the two-cycle engine of an outboard motor.

SUMMARY OF THE INVENTION

A first feature of this invention is adapted to be embodied in a two-cycle, crankcase compression internal combustion engine having a crankcase, a cylinder bore terminating at the crankcase, a cylinder head closing the cylinder bore, a piston reciprocationg in the cylinder bore and means for admitting at least an air charge to the crankcase. Transfer passage means comprising a plurality of circumferentially spaced passages extend from the crankcase to the cylinder bore for transfer of a charge from the crankcase to the cylinder bore. In accordance with this feature of the invention, charge forming means are provided for delivering fuel directly to less than all of the transfer passages.

Another feature of this invention is adapted to be embodied in a two-cycle, crankcase compression internal combustion engine having a cylinder bore that extends in a substantially horizontal direction and which terminates in a vertically extending crankcase. A cylinder head closes the cylinder bore at the opposite end to the crankcase and a piston is reciprocally supported in the cylinder bore. Means to admit at least an air charge to the crankcase. A transfer passage extends from the crankcase to the cylinder bore for transfer of the charge from the crankcase to the cylinder bore. In accordance with this feature of the invention, charge forming means comprising a carburetor are disposed with the induction passage of the carburetor extending in a substantially horizontally direction and discharging into the transfer passage for admission of a fuel/air mixture to the cylinder bore directly through the transfer passage without having to pass through the crankcase.

DETAILED DESCRIPTION OF THE PREFERRED EMBODIMENT

Figure 1:
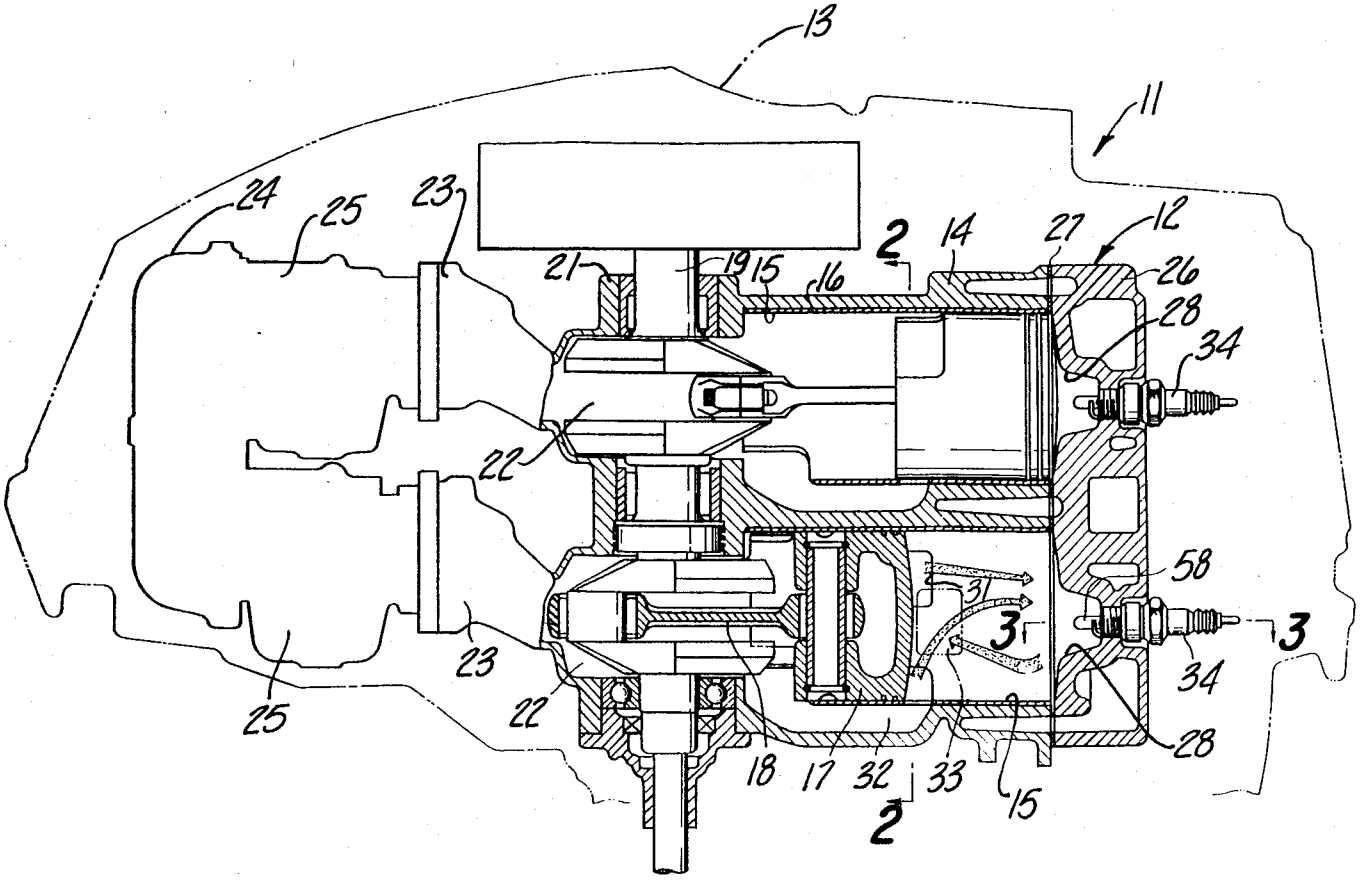
FIG. 1 is a side elevational view, with portions broken away and other portions shown in phantom, of an outboard motor constructed in accordance with an embodiment of the invention.

An outboard motor constructed in accordance with an embodiment of the invention is identified generally by the reference numeral 11. Since the invention is directed primarily with the power head construction of the outboard motor and specifically its internal combustion engine, only the power head has been illustrated. The power head includes an internal combustion engine, indicated generally by the reference numeral 12, and a protective cowling which is shown in phantom and is identified generally by the reference numeral 13. The engine 12, in the illustrated embodiment, is of the two cylinder, two-cycle crankcase compression type and consists of a cylinder block 14 having vertically spaced, horizontally disposed cylinder bores 15. In the illustrated embodiment, the cylinder bores 15 are formed by cylinder liners 16 that are carried by the cylinder block 14 in any suitable manner.

Pistons 17 are reciprocally supported in the cylinder bores 15 and are connected by means of connecting rods 18 to a crankshaft 19. The crankshaft 19 is journaled for rotation about a generally vertically extending axis by suitable bearings interposed between the cylinder block 14 and a crankcase 21 that is affixed to the cylinder block 14 in a suitable manner.

The crankcase 21 is divided into a plurality of spaced sealed chambers 22, each of which is associated with a respective of the cylinder bores 15 for a reason to be described. At least a fresh air charge is delivered to each crankcase chamber 22 through an induction system that includes a manifold 23 in which reed type check valves (not shown) may be provided so as to insure against backflow. The induction system further includes an air inlet device 24 that receives fresh inlet air from the area within the protective cowling 13. Atmospheric air is supplied to the area within the cowling 13 through a suitable air inlet (not shown). The air is delivered, in the illustrated embodiment, from the inlet device 24 to a pair of carburetors 25, each of which delivers a fuel/air mixture to the crankcase chambers 22 through the inlet manifolds 23. For reasons which will become apparent, the carburetors 25 may be dispensed with if desired and only pure air delivered to the crankcase chambers 22.

A cylinder head 26 is affixed to the cylinder block 14 with an interposed cylinder head gasket 27. The cylinder head 26 is provided with individual recesses 28 that are associated with the cylinder bores 15 so as to provide combustion chambers.

The charge which is compressed in the crankcase chambers 22 is transferred to the combustion chambers 28 by means of a Schnurle type of scavenging system. This includes three circumferentially spaced transfer passages 29, 31 and 32, each of which terminates at its lower end in the respective crankcase chamber 22 and its upper end in outlet ports that extend through the cylinder block 14 and cylinder liner 16 into the cylinder bore 15. As may be readily seen in FIG. 2, the transfer passages are circumferentially spaced in such an arrangement that the passages 31 having their inlets and outlets lying in a generally horizontal plane, the passages 32 have their inlets and outlets lying in a generally vertical plane and the passages 29 are offset from the vertical toward the horizontal on the side of a vertical plane spaced from the passage 31. As a result of these dispositions, the intake charge is transferred to the combustion chamber 28 in a pattern as shown by the arrows in FIG. 1 which will promote good scavenging of the chambers 28. The burnt charge is discharged from the chambers 28 through exhaust ports 33 that extend in a generally horizontal direction and which are positioned between the transfer passages 29 and 32. These exhaust gases are discharged to the atmosphere through a suitable exhaust system.

Spark plugs 34 are carried by the cylinder head 26 and are positioned so that their respective gaps extend into the combustion chambers 28 for firing a charge therein. The spark plugs 34 and configuration of the cavities 28 in relation to the transfer ports 29, 31 and 32 and exhaust ports 33 is such so as to insure good scavenging, as has been noted, and also the presence of a rich fuel/air mixture at the gap of the spark plug 34 at the time of firing.

It should be readily apparent that if the carburetors 25 were the only means for delivering fuel to the combustion chambers 28, there would be a likelihood of condensation, particularly at low temperatures, due to the long distance which the fuel must travel before it reaches the combustion chambers 28. This makes it very difficult to use low quality fuel such as kerosene in running conventional engines. Furthermore, even if high quality fuels are used, there is still a likelihood of condensation which could give rise to leanness both during starting and under acceleration. The acceleration condition is particularly acute because the fuel must travel a substantial distance and is considerably heavier than the air. Thus, on acceleration, there could be a leaning of the mixture and poor performance could result.

In accordance with this invention, an arrangement is provided wherein the fuel or at least a portion of it is introduced into the engine directly into the transfer passages. In this way, the fuel has a lesser distance to travel before it reaches the combustion chambers. The introduction of fuel into the transfer passages presents a problem, however, particularly when the compact nature of an outboard motor is considered. However, the positioning of the transfer passages and the manner by which the fuel is introduced to only one of them does provide a very compact arrangement and one in which very efficient fuel introduction may be enjoyed.

Figure 2:
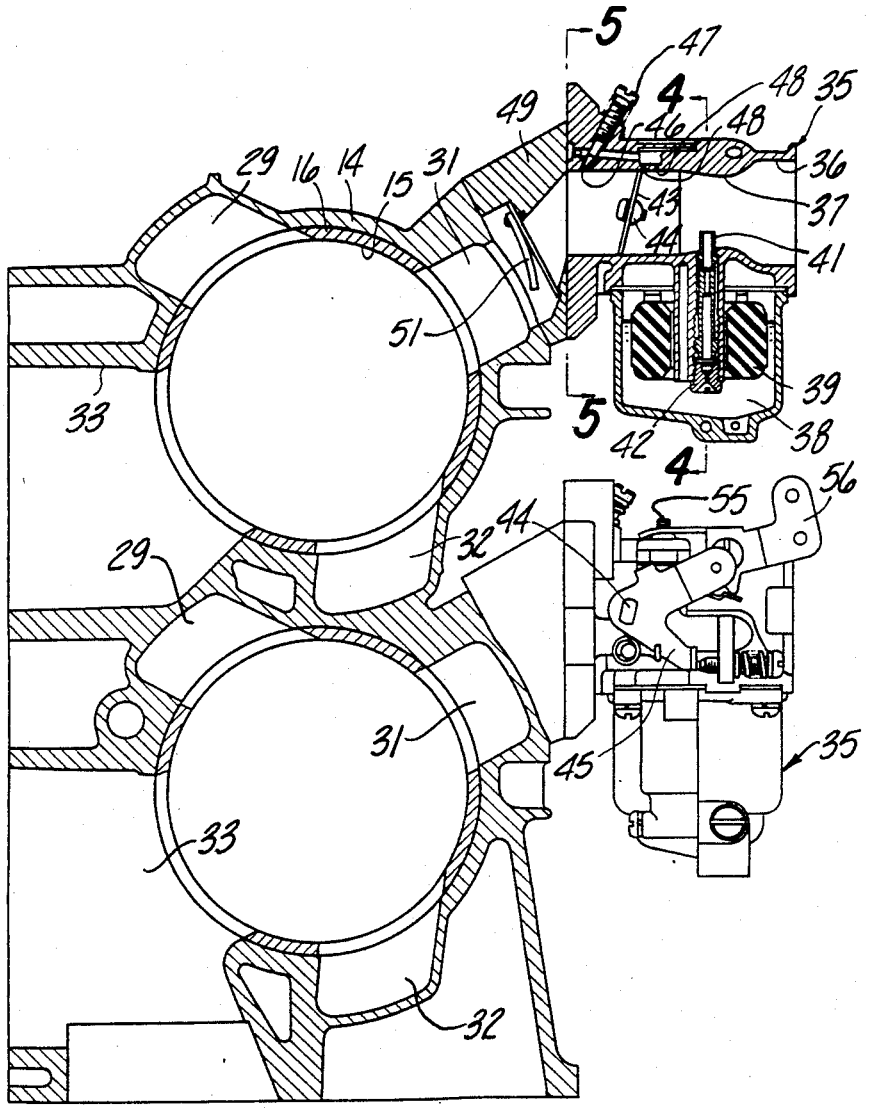
FIG. 2 is an enlarged cross-sectional view taken along the line 2—2 of FIG. 1.
Figure 3:
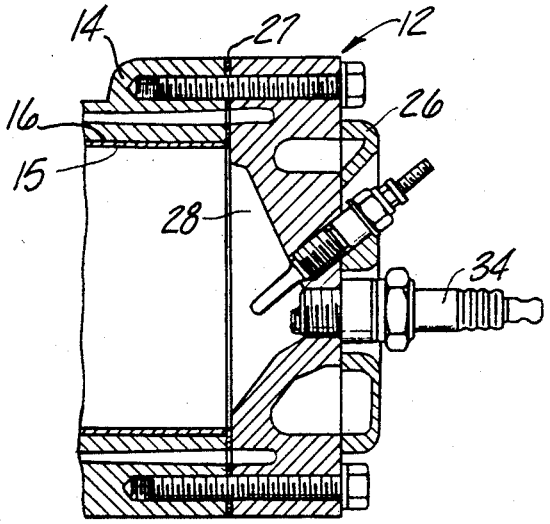
FIG. 3 is a cross-sectional view, on an enlarged scale, taken along the line 3—3 of FIG. 1.
Figure 5:
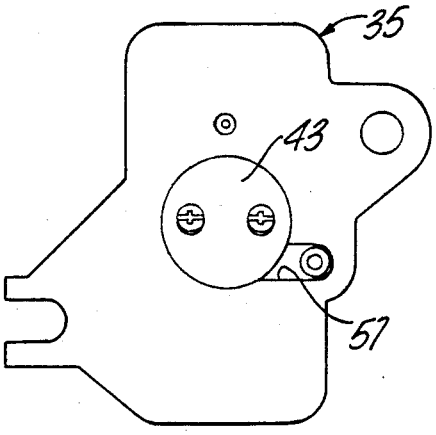
FIG. 5 is a cross-sectional view taken along the line 5—5 of FIG. 2.
Figure 4:
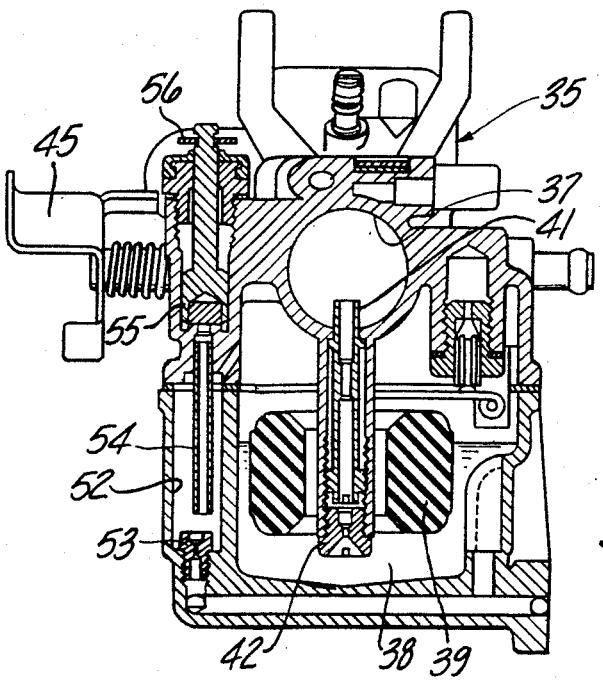
FIG. 4 is a cross-sectional taken through the induction passage of one of the auxiliary carburetors.

Referring now primarily to FIGS. 2, 4 and 5, auxiliary carburetors, indicated generally by the reference numeral 35 are provided for each of the cylinders. The carburetors 35 are of a generally conventional configuration and include a main body having an air intake throat 36 which is horzontally disposed and which terminates at a venturi section 37. A fuel bowl 38 is positioned beneath the venturi section 37 and is charged with fuel to a constant level by means including a valve that is operated by a float 39 in a known manner. A main fuel nozzle 41 extends from a main metering jet 42 positioned below the level of fuel in the fuel bowl 38 into the venturi section 37 for discharging fuel into the air mixture flowing through it.

A throttle valve 43 is rotatably journaled in the carburetor induction passage downstream of the venturi section 37 on a throttle valve shaft 44. A throttle lever 45 is affixed to the throttle valve shaft 44 and these levers 45 of the carburetors are linked together so as to operate simultaneously. In addition, the linkage system connects the throttle valves 43 of the carburators 35 with the corresponding throttle valves of the main carburetors 25 so that all throttle valves will be operated in unison. However, as has been noted, it is possible to operate without the main carburetors 25 and, if this is done, only the throttle valves 43 will be interlinked and operated in unison through an appropriate control.

The carburetors 36 also include an idle system that consists of an idle discharge port 46 whose effective discharge size is controlled by a needle 47. Air is permitted to mix with fuel that is delivered to the port 46 in any suitable manner by means of idle bleed passages 48 that open into the induction system downstream of the venturi section 37 but upstream of the idle position of the throttle valve 43. As is well known, upon opening of the throttle valve 43, fuel and air may also be discharged out of the ports 48 so that they can function as transition ports.

The carburetors 35 each discharge into the transfer passages 31 through a manifold 49 to which they are affixed in a suitable manner. A reed type check valve 51 interconnects the carburetor discharge with the transfer passage 31 so as to avoid any backflow at times when the pressure in the passage 31 exceeds atmospheric. However, the fuel and air which are introduced into the transfer passage 31 need not flow into the crankcase chambers 22 but will be immediately transferred into the combustion chambers 28 when the pressure in the crankcase chambers 22 exceeds that in the combustion chambers 28 and the transfer ports 29, 31 and 32 are opened. Hence, a substantially shorter path is required for the fuel/air mixture to reach the combustion chambers 28 than when fuel is introduced directly into the chambers 22 and the likelihood of condensation is reduced. In addition, there will not be a leaning of fuel under acceleration and better performance under this condition will result, even if low quality fuels are employed.

Carburetors 35 are also provided with a cold start enrichment device. This includes an enrichment well 52 that receives fuel from the fuel bowl 38 through a cold start enrichment jet 53. A cold starting discharge nozzle 54 depends into the well 52 and has its upper end controlled by a cold starting enrichment valve 55. The valve 55 is selectively opened and closed by means of a lever 56 that is pivotally supported on the outer side of the carburetor 35 and which is actuated in any suitable manner. The fuel from the valve 55 is discharged into the induction passage downstream of the throttle valve 43 through a cold starting port 57 (FIG. 5).

In order to further assist in the vaporization of the fuel and to improve running, heating devices 58 are supported by the cylinder head 26 and extend into the combustion chambers 28 in proximity to the spark plug gaps 34. The heating devices 58 are controlled in an appropriate manner, for example, by one of the methods disclosed in application Ser. No. 474,024, filed Mar. 10, 1983 and assigned to the assignee of this application and are disposed so as to be intersected by the flow of fuel-/air mixture from the passage 31 as well as the flow of fuel and air from the passages 29 and 32.

It should be readily apparent from an inspection of FIG. 2 that the orientation of the passages 29, 31 and 32 and the disposition of the carburetors 35 is such that the carburetors 35 are clear of each other and also are clear of any other components under the cowling 13. Thus, not only is a good fuel/air mixture provided under all running conditions including starting and acceleration even though low qualtity fuels are used, but also an extremely compact arrangement is provided.

It is to be understood that the foregoing is only a description of a preferred embodiment of the invention and that various changes and modifications may be made, without departing from the spirit and scope of the invention, as defined by the appended claims.

I claim:

1. In a two-cycle crankcase compression internal combustion engine having a crankcase, a pair of aligned, vertically spaced, horizontally disposed cylinder bores terminating at said crankcase, a cylinder head closing said cylinder bores, pistons reciprocating in said cylinder bores, means for admitting at least an air charge to said crankcase, and transfer passage means comprising a plurality of circumferentially spaced transfer passages extending from said crankcase to each of said cylinder bores for transferring a charge from said crankcase to said cylinder bores, the improvement comprising at least one transfer passage for each of said cylinder bores extending substantially horizontally and not disposed between said cylinder bores, and charge forming means for delivering fuel directly to said horizontally disposed transfer passages, the charge flowing from said charge forming means through said one transfer passage in a generally horizontal direction.

2. In a two-cycle crankcase compression internal combustion engine as set forth in claim 1 wherein there are at least three transfer passages and the charge forming means delivers fuel only to the intermediate of the transfer passages.

3. In a two-cycle crankcase compression internal combustion engine as set forth in claim 1 wherein the charge forming means comprises a carburetor having a substantially horizontally extending induction passage with a fuel bowl disposed beneath said induction passage.

4. In a two-cycle crankcase compression internal combustion engine as set forth in claim 1 wherein there are three transfer passages for each cylinder, one transfer passage discharging into said cylinder in a substantially horizontal direction, one transfer passage discharging into said cylinder in a substantially vertical direction and the remaining transfer passage discharging into said cylinder at an angle between the vertical and horizontal position, the charge forming means being associated only with the horizontally discharging transfer passage.

5. In a two-cycle crankcase compression internal combustion engine as set forth in claim 1 wherein the charge forming means includes means for providing cold running enrichment.

6. In a two-cycle crankcase compression internal combustion engine as set forth in claim 1 wherein there is a separate charge forming means for each cylinder.

7. In a two-cycle crankcase compression internal combustion engine as set forth in claim 6 wherein the charge forming means are disposed one above the other.

8. In a two-cycle compression internal combustion engine as set forth in claim 1 wherein the engine is associated with the power head of an outboard motor for driving an associated watercraft and further including cowling means enclosing the engine and the charge forming means.

9. In a two-cycle crankcase compression internal combustion engine as set forth in claim 8 wherein there is a separate charge forming means for each cylinder.

10. In a two-cycle crankcase compression internal combustion engine as set forth in claim 9 wherein the charge forming means are disposed one above the other.

11. In a two-cycle crankcase compression internal combustion engine having a crankcase, a horizontally disposed cylinder bore terminating at said crankcase, a cylinder head closing said cylinder bore, a piston reciprocating in said cylinder bore, means for admitting at least an air charge to said crankcase, and transfer passage means comprising a plurality of circumferentially spaced transfer passages extending from said crankcase to said cylinder bore for transferring a charge from said crankcase to said cylinder bore, the improvement comprising charge forming means for delivering fuel directly to less than all of said transfer passages, the charge flowing from said charge forming means through the transfer passage in a generally horizontal direction, and heating means disposed to intersect the path of fuel/air charge from the transfer passage before firing by a spark plug in said cylinder head.

12. In a two-cycle crankcase compression internal combustion engine as set forth in claim 11 wherein the heating means is disposed in the cylinder head.

13. In a two-cycle crankcase compression internal combustion engine as set forth in claim 12 wherein the charge forming means includes means for providing cold running enrichment.

14. In a two-cycle crankcase compression internal combustion engine having a crankcase, a horizontally disposed cylinder bore terminating at said crankcase, a cylinder head closing said cylinder bore, a piston reciprocating in said cylinder bore, first charge forming means for admitting a fuel/air charge directly to said crankcase, and transfer passage means comprising a plurality of circumferentially spaced transfer passages extending from said crankcase to said cylinder bore for transferring a charge from said crankcase to said cylinder bore, the improvement comprising second charge forming means for delivering fuel directly to less than all of said transfer passages, said second charge forming means delivering fuel in a generally horizontal direction to only one transfer passage.

15. In a two-cycle crankcase compression internal combustion engine as set forth in claim 14 wherein the second charge forming means comprises a carburetor having a substantially horizontally extending induction passage with a fuel bowl disposed beneath said induction passage.

16. In a two-cycle crankcase compression internal combustion engine as set forth in claim 14 wherein the second charge forming means includes means for providing cold running enrichment.

17. In a two-cycle crankcase compression internal combustion engine as set forth in claim 14 wherein the engine has a plurality of horizontally extending cylinders each communicating with a respective crankcase chamber through respective transfer passage means.

18. In a two-cycle crankcase compression internal combustion engine as set forth in claim 17 wherein there are three transfer passages for each cylinder, one transfer passage discharging into said cylinder in a substantially horizontal direction, one transfer passage discharging into said cylinder in a substantially vertical direction and the remaining transfer passage discharging into said cylinder at an angle between the vertical and horizontal position, the charge forming means being associated only with the horizontally discharging transfer passage.

19. In a two-cycle crankcase compression internal combustion engine as set forth in claim 18 wherein the engine is associated with the power head of an outboard motor for driving an associated watercraft and further including cowling means enclosing the engine and the charge forming means.

20. In a two-cycle crankcase compression internal combustion engine as set forth in claim 19 wherein there are a plurality of second separate charge forming means, one for each cylinder.

21. In a two-cycle crankcase compression internal combustion engine as set forth in claim 20 wherein the second charge forming means are disposed one above the other.

22. In a two-cycle crankcase compression internal combustion engine having a crankcase, a cylinder bore terminating at said crankcase, a cylinder head closing said cylinder bore, a piston reciprocating in said cylinder bore, first charge forming means for admitting a fuel/air charge directly to said crankcase, and transfer passage means comprising a plurality of circumferentially spaced transfer passages extending from said crankcase to said cylinder bore for transferring a charge from said crankcase to said cylinder bore, the improvement comprising second charge forming means for delivering fuel directly to less than all of said transfer passages, and heating means disposed to intersect the path of fuel/air charge from the transfer passage before firing by a spark plug in the cylinder head.

23. In a two-cycle crankcase compression internal combustion engine as set forth in claim 22 wherein the heating means is disposed in the cylinder head.

24. In a two-cycle crankcase compression internal combustion engine as set forth in claim 23 wherein the second charge forming means includes means for providing cold running enrichment.

25. In a two-cycle crankcase compression internal combustion engine having a crankcase, a pair of horizontally disposed cylinder bores terminating at said crankcase, cylinder head means closing said cylinder bores, a piston reciprocating in each of said cylinder bores, means for admitting at least an air charge to said crankcase, and transfer passage means comprising a plurality of circumferentially spaced transfer passages extending from said crankcase to each of said cylinder bores for transferring a charge from said crankcase to said cylinder bores, the improvement comprising charge forming means for delivering fuel directly to less than all of said transfer passages, the charge flowing through said charge forming means in a generally horizontal direction, there being a plurality of separate charge forming means, one for each cylinder.

26. In a two-cycle crankcase compression internal combustion engine as set forth in claim 25 wherein the charge forming means are disposed one above the other.

* * * * *